US006387582B2

(12) United States Patent
Kayamoto et al.

(10) Patent No.: US 6,387,582 B2
(45) Date of Patent: May 14, 2002

(54) CARRIER FOR ELECTROPHOTOGRAPHIC DEVELOPER AND ELECTROPHOTOGRAPHIC DEVELOPER CONTAINING THE SAME

(75) Inventors: Kanao Kayamoto; Kazunori Takagi; Yuji Sato, all of Chiba (JP)

(73) Assignee: Powdertech Co., Ltd., Chiba (JP)

( * ) Notice: Subject to any disclaimer, the term of this patent is extended or adjusted under 35 U.S.C. 154(b) by 0 days.

(21) Appl. No.: 09/780,519

(22) Filed: Feb. 12, 2001

(30) Foreign Application Priority Data

Mar. 24, 2000 (JP) ..... 2000-083708

(51) Int. Cl.[7] ..... G03G 9/113

(52) U.S. Cl. ..... 430/111.1; 430/111.32; 430/111.35

(58) Field of Search ..... 430/111.1, 111.3, 430/111.31, 111.32, 111.33, 111.34, 111.35, 108, 106.6, 111

(56) References Cited

U.S. PATENT DOCUMENTS 3,562,533 A 2/1971 Doyle et al. ..... 359/160

FOREIGN PATENT DOCUMENTS

| | | | |
|---|---|---|---|
| JP | 54-7343 | | 1/1979 |
| JP | 56-75659 | | 6/1981 |
| JP | 59-131944 | | 7/1984 |
| JP | 3-259157 | | 11/1991 |
| JP | 7-140723 | | 6/1995 |
| JP | 7-160059 | * | 6/1995 |
| JP | 7-219281 | | 8/1995 |
| JP | 8-146663 | | 6/1996 |
| JP | 8-179570 | | 7/1996 |
| JP | 8-286429 | | 11/1996 |
| WO | WO 99/38051 | | 7/1999 |

OTHER PUBLICATIONS

Japanese Patent Office Machine–Assisted Translation of JP–7–160059, Jun. 1995.*

Japanese Patent Office Machine–Assisted Translation of JP–8–179570, Jul. 1996.*

Patent Abstracts of Japan of JP 03–231760, published Oct. 1991.

* cited by examiner

*Primary Examiner*—Janis L. Dote
(74) *Attorney, Agent, or Firm*—Young & Thompson

(57) ABSTRACT

A carrier for an electrophotographic developer which comprises a carrier core and a resin coat having a conducting agent dispersed therein, the resin coat having an inner layer on the carrier core side and an outer layer coating the inner layer, wherein the inner layer contains 7 to 20% by weight of a conducting agent based on the resinous solid content of the inner layer, the outer layer contains 3 to 15% by weight of a conducting agent based on the resinous solid content of the outer layer, and the conducting agent content of the inner layer is greater than that of the outer layer.

8 Claims, No Drawings

CARRIER FOR ELECTROPHOTOGRAPHIC DEVELOPER AND ELECTROPHOTOGRAPHIC DEVELOPER CONTAINING THE SAME

BACKGROUND OF THE INVENTION

1. Field of the Invention

The present invention relates to a carrier for an electrophotographic developer and an electrophotographic developer containing the same. More particularly, the carrier of the present invention has an optimum resistance, is prevented from reducing its charging ability, and thereby provides an electrophotographic developer which has an extended service life, achieves high printing density, and causes no toner scattering nor fogging.

2. Description of the Related Art

It has been proposed to coat carrier particles for two-component developers with various resins so as to extend the service life of developers and to ensure high image quality as disclosed, e.g., in U.S. Pat. No. 3,526,533 and Japanese Patent Laid-Open No. 59-131944. Silicone resins, acrylic resins, fluoro/acrylic resins or like resins have high resistance, however, only to provide resin-coated carriers with increased resistance, which will cause such defects as an edge effect and an increase of charge quantity, failing to exhibit desired performance.

As a countermeasure, incorporation of an electrically conductive substance (conducting agent) such as carbon black into the resin coat of resin-coated carriers has been proposed as taught, e.g., in Japanese Patent Laid-Open Nos. 56-75659 and 54-7343. Carbon black, etc. dispersed in the resin coat acts to decrease the carrier resistance thereby improving developing properties and suppressing an increase of charge quantity.

However, as the amount of a conducting agent on the carrier surface increases, the carrier reduces its charging ability. It follows that toner particles with insufficient charges are produced, which may be scattered or cause image defects such as fog.

To overcome the problem, attempts have been made to improve carrier performance by providing a resin coat comprising two or more layers as disclosed in Japanese Patent Laid-Open Nos. 3-259157, 7-140723, 7-219281, 8-179570, and 8-146663. However, since the outer surface layer of the resin coat according to these methods contains no conducting agent, the resin coat has a high surface resistance to reduce the electrode effect of the carrier. The effect in suppressing an increase of charge quantity is also lessened, and the performance as expected cannot be obtained.

Japanese Patent Laid-Open No. 8-286429 proposes a carrier for a dry two-component developer, in which the resin coat has a double layer structure containing conductive carbon black in its inner layer and a white conducting agent in its outer layer. Because of the difference between the inner and the outer layers in kind of the conducting agent incorporated, the resin coated carrier has insufficient strength, that is, insufficient durability.

SUMMARY OF THE INVENTION

An object of the present invention is to provide a carrier which has an optimum resistance, is prevented from reducing its charging ability, and thereby provides an electrophotographic developer which has an extended service life, achieves high printing density, and causes no toner scattering nor fogging; and a developer containing the carrier.

As a result of extensive investigation, the present inventors have found that the above object is accomplished by a carrier coated with a double-layered resin coat having an outer layer and an inner layer each containing the respective amount of a conducting agent, the inner layer having a higher conductive agent content than the outer layer.

Based on the above finding, the present invention provides a carrier for an electrophotographic developer which comprises a carrier core and a resin coat having a conducting agent dispersed therein, the resin coat having an inner layer on the carrier core side and an outer layer coating the inner layer, wherein the inner layer contains 7 to 20% by weight of the conducting agent based on the resinous solid content of the inner layer, the outer layer contains 3 to 15% by weight of the conducting agent based on the resinous solid content of the outer layer, and the conducting agent content A (wt %) of the inner layer and the conducting agent content B (wt %) of the outer layer satisfies the relationship: $B/A<1.0$.

The present invention also provides an electrophotographic developer comprising the above-described carrier and a toner.

The carrier for an electrophotographic developer of the present invention has optimized resistance and charging ability so that reduction in image density due to an increase of charge quantity and reduction in charging ability are prevented. The developer containing the carrier of the invention has a prolonged service life, achieves a high printing density, and does not cause toner scattering or fog.

DETAILED DESCRIPTION OF THE INVENTION

The carrier of the present invention has a resin coat comprising an insulating resin having dispersed therein a conducting agent. The resin coat has a double layer structure composed of an inner layer on the core side and an outer layer which coats the inner layer.

The insulating resin which can be used includes polyolefin resins, such as polyethylene, polypropylene, chlorinated polyethylene, and chlorosulfonated polyethylene; polyvinyl or polyvinylidene resins, such as polystyrene, acrylic resins (e.g., polymethyl methacrylate), polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymers; styrene-acrylic acid copolymers; silicone resins, such as a straight silicone resin composed of an organosiloxane bond, or modified resins thereof (e.g., alkyd-, polyester-, epoxy- or polyurethane-modified silicone resins); fluororesins, such as polytetrafluoroethylene, polyvinyl fluoride, polyvinylidene fluoride, and polychlorotrifluoroethylene, and modified fluororesins; polyamide; polyester resins, such as polyethylene terephthalate; polyurethane; polycarbonate; amino resins, such as urea-formaldehyde resins; and epoxy resins. Of these resins, preferred are acrylic resins, silicone resins or modified silicone resins, and fluororesins or modified fluororesins. Silicone resins and modified silicone resins are particularly preferred.

The resins making the inner layer and the outer layer may be the same or different, but it is usually preferred to use the same resin.

A curing catalyst can be added to these resins. Curing catalysts suitable for silicone resins, for example, include octylic acid and quaternary ammonium salts, such as tetramethylammonium acetate.

The conducting agents include carbon black (e.g., KETJEN BLACK, furnace black or acetylene black) and white conducting agents, such as $TiO_2$, $ZnO_2$ and $SnO_2$. Carbon black is particularly preferred. Of the white conducting agents $TiO_2$ is preferred.

The conducting agent content in the inner layer is 7 to 20% by weight, preferably 10 to 15% by weight, based on the resinous solid content of that layer. The conducting agent content in the outer layer is 3 to 15% by weight, preferably 5 to 10% by weight, based on the resinous solid content of that layer. If the conducting agent content in the inner layer or the outer layer is less than 7% by weight or 3% by weight, respectively, the charge quantity increases to reduce the image density. If the conducting agent content in the inner layer or the outer layer exceeds 20% by weight or 15% by weight, respectively, the charging ability reduces to cause fog.

The conducting agent content in the inner layer, taken as A % by weight, and that in the outer layer, taken as B % by weight, should satisfy the relationship: $B/A<1.0$. B/A is preferably in the range of from 0.2 to 0.8. If $B/A \geqq 1.0$, fog occurs, and the toner is scattered to cause image defects in long-term use.

Conventionally known carriers can be used as a core material to be coated, such as iron powder, ferrite powder, and magnetite powder. Ferrite powder of various kinds is preferred because ferrite powder is easy to control as to the surface condition, shape, resistance, etc. which are influential on the characteristics of the carrier after being coated. The carrier particles preferably have an average particle size of 20 to 200 $\mu$m.

The total coating weight of the resin on the core, inclusive of the inner and outer layers, is 0.03 to 5.0% by weight, preferably 0.05 to 3.0% by weight, based on the core. A coating weight less than 0.03% tends to fail to form a uniform coat on the carrier surface. A coating weight exceeding 5.0% forms a so thick resin coat that the coated carrier particles may agglomerate with each other, and it would be difficult to obtain uniform carrier particles.

Coating of the carrier core with the resin is usually conducted by a wet process comprising applying the resin as diluted with a solvent onto the surface of the core by dipping, spraying, brushing, kneading or a like technique and volatilizing the solvent. A dry process comprising coating the core with a powdered resin is also employable.

After coating, the coating layer can be baked, if desired, either by external heating or internal heating by means of, for example, a fixed bed or fluidized bed electric oven, a rotary kiln type electric oven, a burner oven, or a microwave oven. The baking temperature preferably ranges from 150 to 300° C.

The resin-coated carrier according to the present invention is mixed with a toner to provide a two-component developer. The toner to be used comprises a binder resin having dispersed therein a colorant, a charge control agent, etc. Known black and color toners can be utilized.

While not limiting, the binder resin which can be used in the toner includes polystyrene, chloropolystyrene, a styrene-chlorostyrene copolymer, a styrene-acrylic ester copolymer, a styrene-methacrylic acid copolymer, a rosin-modified maleic acid resin, an epoxy resin, a polyester resin, a polyethylene resin, a polypropylene resin, and a polyurethane resin. These binder resins can be used either individually or as a mixture thereof.

The charge control agent which can be used in the toner is selected arbitrarily. Useful charge control agents for positively chargeable toners include nigrosine dyes and quaternary ammonium salts, and those for negatively chargeable toners include metallized monoazo dyes.

Any well-known dyes and/or pigments are useful as a colorant. Examples of suitable colorants are carbon black, Phthalocyanine Blue, Permanent Red, Chrome Yellow, and Phthalocyanine Green. The colorant is usually used in an amount of about 0.5 to 10 parts by weight per 100 parts by weight of the binder resin. External additives, such as fine silica powder and titania, can be added to the toner particles for improvement on fluidity and anti-agglomeration.

The method for preparing the toner is not particularly restricted. For example, a binder resin, a charge control agent and a colorant are dry blended thoroughly in a mixing machine, e.g., a Henschel mixer, and the blend is melt-kneaded in, e.g., a twin-screw extruder. After cooling, the mixture is ground, classified, and mixed with necessary external additives in a mixing machine, etc.

The carrier of the present invention has a resin coat to exhibit improved durability and contains in its resin coat a conducting agent for suppressing an increase of charge quantity and for decreasing the resistance to thereby improve developing properties. In addition to this structure, the resin coat of the carrier is composed of an inner layer and an outer layer different in content of the conducting agent. The conducting agent in the inner layer ensures retention of the optimum resistance of the carrier. The conducting agent content in the outer layer being made smaller than that in the inner layer, the carrier is prevented from reducing the charging ability. As a result, the carrier resistance can be optimized, and reduction in charging ability can be prevented, thereby prolonging the life of the developer and achieving high density printing. Further, the developer exhibits high performance free from toner scattering or fog.

The present invention will now be illustrated in greater detail with reference to Examples. Unless otherwise noted all the percents are by weight.

EXAMPLE 1

A monomethylsilicone resin having a number average molecular weight of about 15000 was mixed with 10% of electrically conductive carbon black (KETJEN BLACK EC-600, available from Ketjen Black International) and 4% of octylic acid as a catalyst to prepare a resin composition for an inner layer.

The same silicone resin was mixed with 7% of the same carbon black and 4% of octylic acid to prepare a resin composition for an outer layer.

An Mn-based ferrite powder having an average particle size of 100 $\mu$m was coated with the resin composition for an inner layer in a fluidized bed coating apparatus to a coating weight of 1.0% based on the ferrite powder and then coated with the resin composition for an outer layer to a coating weight of 0.5% based on the ferrite powder. The coated powder was baked at 260° C. for 3 hours. After cooling, the product was disintegrated to obtain carrier 1. The conditions used in the preparation of carrier 1 are summarized in Table 1 below.

Carrier 1 was mixed with a positively chargeable polyester toner to prepare a developer having a toner concentration of 3%. The developer was tested on a digital copier Creage 7350 (supplied by Mita Industrial Co., Ltd.) to make 100,000 copies. The carrier physical properties (charge quantity, resistance, and fluidity) in the initial state of copying and after the copying test, the image characteristics (image density and fog), and the overall judgement on the developer are shown in Table 2 below. Measurement of the carrier physical properties and the image characteristics and the overall judgement were made as follows.

1) Charge quantity

Measured with a blow-off powder charge quantity meter manufactured by Toshiba Chemical Co., Ltd.

2) Resistance

Measured with SM-5E SUPER MEGOHM METER manufactured by Toa Electronics LTd.

3) Fluidity

Measured in accordance with JIS-Z 2502 "Determination of Flowability of Metallic Powders".

4) Image Density

The image density of a solid image area was measured with a Macbeth densitometer.

5) Fog

The fog on the white background was measured with a color difference meter Z-300 manufactured by Nippon Denshoku Kogyo K.K.

6) Overall Judgement

Overall judgement on the performance of the developer was made based on the image density according to the following rating system.

A . . . A high level of achievement is marked, showing an image density of 1.35 or more and a fog of 0.8 or less in both the initial stage and the end of the copying test.

B . . . An aimed level of achievement is marked, showing an image density of 1.30 or more and a fog of 1.0 or less in both the initial state and the end of the copying test.

C . . . The performance is acceptable, showing an image density of 1.30 or more and a fog of 1.1 or less in both the initial stage and the end of the copying test.

D . . . The image characteristics were unacceptable, not achieving the aimed level.

E . . . The image characteristics were still poorer than D.

EXAMPLE 2

Resin compositions for an inner layer and for an outer layer were prepared in the same manner as in Example 1, except for changing the carbon black contents to 13% and 5%, respectively, based on the monomethylsilicone resin.

The same Mn-based ferrite powder as used in Example 1 was coated with the resin compositions, baked, cooled, and disintegrated in the same manner as in Example 1 to prepare carrier 2. The preparation conditions are shown in Table 1.

A developer having a toner concentration of 3% was prepared by mixing carrier 2 with a positively chargeable polyester toner and evaluated in the same manner as in Example 1. The results obtained are shown in Table 2.

EXAMPLE 3

Resin compositions for an inner layer and for an outer layer were prepared in the same manner as in Example 1, except for using 2% of tetramethylammonium acetate as a catalyst.

The same Mn-based ferrite powder as used in Example 1 was coated with the resin compositions, baked, cooled, and disintegrated in the same manner as in Example 1 to prepare carrier 3. The preparation conditions are shown in Table 1.

A developer having a toner concentration of 3% was prepared by mixing carrier 3 with a positively chargeable polyester toner and evaluated in the same manner as in Example 1. The results obtained are shown in Table 2.

EXAMPLE 4

Resin compositions for an inner layer and for an outer layer were prepared in the same manner as in Example 1, except for replacing carbon black with titanium oxide as a conducting agent and changing the conducting agent contents to 20% and 15%, respectively, based on the monomethylsilicone resin.

The same Mn-based ferrite powder as used in Example 1 was coated with the resin compositions, baked, cooled, and disintegrated in the same manner as in Example 1 to prepare carrier 4. The preparation conditions are shown in Table 1.

A developer having a toner concentration of 3% was prepared by mixing carrier 4 with a positively chargeable polyester toner and evaluated in the same manner as in Example 1. The results obtained are shown in Table 2.

EXAMPLE 5

Resin compositions for an inner layer and for an outer layer were prepared in the same manner as in Example 1, except for replacing the monomethylsilicone resin with a fluororesin.

The same Mn-based ferrite powder as used in Example 1 was coated with the resin compositions in the same manner as in Example 1, baked at 220° C. for 2 hours, and, after cooling, disintegrated to prepare carrier 5. The preparation conditions are shown in Table 1.

A developer having a toner concentration of 3% was prepared by mixing carrier 5 with a positively chargeable polyester toner and evaluated in the same manner as in Example 1. The results obtained are shown in Table 2.

EXAMPLE 6

Resin compositions for an inner layer and for an outer layer were prepared in the same manner as in Example 1, except for changing the conducting agent contents to 7% and 3%, respectively, based on the monomethylsilicone resin.

The same Mn-based ferrite powder as used in Example 1 was coated with the resin compositions, baked, cooled, and disintegrated in the same manner as in Example 1 to prepare carrier 6. The preparation conditions are shown in Table 1.

A developer having a toner concentration of 3% was prepared by mixing carrier 6 with a positively chargeable polyester toner and evaluated in the same manner as in Example 1. The results obtained are shown in Table 2.

EXAMPLE 7

Resin compositions for an inner layer and for an outer layer were prepared in the same manner as in Example 1, except for changing the conducting agent contents to 17% and 15%, respectively, based on the monomethylsilicone resin.

The same Mn-based ferrite powder as used in Example 1 was coated with the resin compositions, baked, cooled, and disintegrated in the same manner as in Example 1 to prepare carrier 7. The preparation conditions are shown in Table 1.

A developer having a toner concentration of 3% was prepared by mixing carrier 7 with a positively chargeable polyester toner and evaluated in the same manner as in Example 1. The results obtained are shown in Table 2.

Comparative Example 1

The same monomethylsilicone resin as used in Example 1 was mixed with 17% of the same carbon black as used in Example 1, and 4% of octylic acid was added thereto to prepare a coating resin composition.

The same Mn-based ferrite powder as used in Example 1 was coated with the resin composition in a fluidized bed coating apparatus to a coating weight of 1.5% based on the ferrite powder. The coated particles were baked and, after cooling, disintegrated in the same manner as in Example 1 to obtain carrier 8. The conditions of coated carrier preparation are shown in Table 1.

A developer having a toner concentration of 3% was prepared by mixing carrier 8 with a positively chargeable polyester toner and evaluated in the same manner as in Example 1. The results obtained are shown in Table 2.

Comparative Example 2

A resin composition for an inner layer was prepared in the same manner as in Example 1, except for changing the conducting agent content to 17% based on the monomethylsilicone resin. A solution of the same resin containing no carbon black was used as a coating resin for an outer layer.

The same Mn-based ferrite powder as used in Example 1 was coated with the resin compositions, baked, cooled, and disintegrated in the same manner as in Example 1 to prepare carrier 9. The preparation conditions are shown in Table 1.

A developer having a toner concentration of 3% was prepared by mixing carrier 9 with a positively chargeable polyester toner and evaluated in the same manner as in Example 1. The results obtained are shown in Table 2.

Comparative Example 3

The same monomethylsilicone resin as used in Example 1 was used as such as a coating resin.

The same Mn-based ferrite powder as used in Example 1 was coated with the coating resin, baked, cooled, and disintegrated in the same manner as in Example 1 to prepare carrier 10. The preparation conditions are shown in Table 1.

A developer having a toner concentration of 3% was prepared by mixing carrier 10 with a positively chargeable polyester toner and evaluated in the same manner as in Example 1. The results obtained are shown in Table 2.

Comparative Example 4

Resin compositions for an inner layer and for an outer layer were prepared in the same manner as in Example 1, except for changing the conducting agent contents to 3% and 7%, respectively, based on the monomethylsilicone resin.

The same Mn-based ferrite powder as used in Example 1 was coated with the resin composition for an inner layer in a fluidized bed coating apparatus to a coating weight of 1.0% based on the ferrite powder and then coated with the resin composition for an outer layer to a coating weight of 0.5% based on the ferrite powder. The coated powder was baked, cooled, and disintegrated in the same manner as in Example 1 to prepare carrier 11. The preparation conditions are shown in Table 1.

A developer having a toner concentration of 3% was prepared by mixing carrier 11 with a positively chargeable polyester toner and evaluated in the same manner as in Example 1. The results obtained are shown in Table 2.

Comparative Example 5

A coating resin composition was prepared in the same manner as in Comparative Example 1, except for replacing the monomethylsilicone resin with a fluororesin.

The same Mn-based ferrite powder as used in Example 1 was coated with the resin composition in the same manner as in Example 1, baked at 220° C. for 2 hours, and, after cooling, disintegrated to prepare carrier 12. The preparation conditions are shown in Table 1.

A developer having a toner concentration of 3% was prepared by mixing carrier 12 with a positively chargeable polyester toner and evaluated in the same manner as in Example 1. The results obtained are shown in Table 2.

TABLE 1

| | | | | | | Inner Layer | | Outer Layer | | | |
|---|---|---|---|---|---|---|---|---|---|---|---|
| | Carrier | Core | Coating Resin | Curing Catalyst | Conducting Agent | Coating Weight (wt %) | A[3] (wt %) | Coating Weight (wt %) | B[4] (wt %) | B/A | Baking Temp. (° C.) |
| Example 1 | 1 | Mn ferrite | Me-Si | octylic acid | EC-600[2] | 1.0 | 10 | 0.5 | 7 | 0.70 | 260 |
| Example 2 | 2 | Mn ferrite | Me-Si | octylic acid | EC-600 | 1.0 | 13 | 0.5 | 5 | 0.38 | 260 |
| Example 3 | 3 | Mn ferrite | Me-Si | TMAA[1] | EC-600 | 1.0 | 10 | 0.5 | 7 | 0.70 | 260 |
| Example 4 | 4 | Mn ferrite | Me-Si | Octylic acid | $TiO_2$ | 1.0 | 20 | 0.5 | 15 | 0.75 | 260 |
| Example 5 | 5 | Mn ferrite | fluoro-resin | None | EC-600 | 1.0 | 10 | 0.5 | 7 | 0.70 | 220 |
| Example 6 | 6 | Mn ferrite | Me-Si | octylic acid | EC-600 | 1.0 | 7 | 0.5 | 3 | 0.43 | 260 |
| Example 7 | 7 | Mn ferrite | Me-Si | octylic acid | EC-600 | 1.0 | 17 | 0.5 | 15 | 0.88 | 260 |
| Comp. Example 1 | 8 | Mn ferrite | Me-Si | octylic acid | EC-600 | 1.5 | 17 | — | — | — | 260 |
| Comp. Example 2 | 9 | Mn ferrite | Me-Si | octylic acid | EC-600 | 1.0 | 17 | 0.5 | none | — | 260 |
| Comp. Example 3 | 10 | Mn ferrite | Me-Si | octylic acid | none | 1.5 | 0 | — | — | — | 260 |
| Comp. Example 4 | 11 | Mn ferrite | Me-Si | octylic acid | EC-600 | 1.0 | 3 | 0.5 | 7 | 2.33 | 260 |
| Comp. Example 5 | 12 | Mn ferrite | Fluoro-resin | None | EC-600 | 1.5 | 17 | — | — | — | 220 |

Note:
[1]Tetramethylammonium acetate
[2]Conductive carbon black (Ketjen Black)
[3]Conducting agent content
[4]Conducting agent content

TABLE 2

| | | Initial Stage | | | | | After Obtaining 100,000 Copies | | | | | |
|---|---|---|---|---|---|---|---|---|---|---|---|---|
| | | Carrier Physical Properties | | | Image Characteristics | | Carrier Physical Properties | | | Image Characteristics | | |
| | Carrier | Charge Quantity (μc/g) | Resistance (Ω) | Fluidity (s) | Image Density | Fog | Charge Quantity (μC/g) | Resistivity (Ω) | Fluidity | Image Density | Fog | Overall Judgement |
| Ex. 1 | 1 | 13.4 | $5.2 \times 10^7$ | 27.1 | 1.43 | 0.45 | 15.2 | $5.8 \times 10^7$ | 26.8 | 1.42 | 0.62 | A |
| Ex. 2 | 2 | 14.2 | $8.6 \times 10^7$ | 27.5 | 1.42 | 0.52 | 16.1 | $3.1 \times 10^7$ | 26.4 | 1.39 | 0.72 | A |

TABLE 2-continued

| | | Initial Stage | | | | | After Obtaining 100,000 Copies | | | | | |
|---|---|---|---|---|---|---|---|---|---|---|---|---|
| | | Carrier Physical Properties | | | Image Characteristics | | Carrier Physical Properties | | | Image Characteristics | | |
| | Carrier | Charge Quantity ($\mu$c/g) | Resistance ($\Omega$) | Fluidity (s) | Image Density | Fog | Charge Quantity ($\mu$C/g) | Resistivity ($\Omega$) | Fluidity | Image Density | Fog | Overall Judgement |
| Ex. 3 | 3 | 12.1 | $3.8 \times 10^7$ | 28.3 | 1.41 | 0.75 | 15.2 | $6.7 \times 10^7$ | 25.3 | 1.40 | 0.67 | A |
| Ex. 4 | 4 | 12.4 | $6.4 \times 10^8$ | 28.6 | 1.35 | 0.82 | 17.9 | $1.4 \times 10^8$ | 26.4 | 1.33 | 0.75 | B |
| Ex. 5 | 5 | 15.2 | $4.2 \times 10^7$ | 31.2 | 1.46 | 0.95 | 18.6 | $5.6 \times 10^8$ | 28.6 | 1.34 | 0.91 | B |
| Ex. 6 | 6 | 15.7 | $6.8 \times 10^8$ | 28.1 | 1.31 | 0.56 | 19.1 | $8.4 \times 10^8$ | 27.9 | 1.31 | 0.62 | B |
| Ex. 7 | 7 | 15.3 | $2.1 \times 10^6$ | 29.1 | 1.41 | 1.08 | 15.4 | $4.1 \times 10^6$ | 27.1 | 1.39 | 1.06 | C |
| Comp. Ex. 1 | 8 | 11.1 | $<1.0 \times 10^6$ | 29.4 | 1.42 | 2.30 | 14.6 | $1.2 \times 10^6$ | 26.3 | 1.43 | 1.63 | D |
| Comp. Ex. 2 | 9 | 17.1 | $5.2 \times 10^{11}$ | 28.2 | 1.12 | 0.95 | 16.6 | $8.1 \times 10^7$ | 26.8 | 1.38 | 1.28 | D |
| Comp. Ex. 3 | 10 | 18.7 | $8.2 \times 10^{11}$ | 27.9 | 0.96 | 0.41 | 23.2 | $9.1 \times 10^{11}$ | 27.2 | 0.76 | 0.85 | E |
| Comp. Ex. 4 | 11 | 13.3 | $4.8 \times 10^7$ | 29.8 | 1.36 | 0.94 | 20.3 | $5.3 \times 10^9$ | 26.9 | 1.14 | 0.84 | D |
| Comp. Ex. 5 | 12 | 12.3 | $<1.0 \times 10^6$ | 31.1 | 1.40 | 1.66 | 15.1 | $3.2 \times 10^6$ | 29.3 | 1.39 | 1.28 | D |

As is shown in Table 2, in Examples 1 to 7 reduction of charging ability is prevented, an increase in charge quantity is suppressed, and satisfactory image characteristics are obtained in density and fog as compared with in Comparative Example 1 to 5.

What is claimed is:

1. A carrier for an electrophotographic developer which comprises a carrier core and a resin coat having a conducting agent dispersed therein, the resin coat having an inner layer on the carrier core side and an outer layer coating the inner layer, wherein said inner layer contains 7 to 20% by weight of a conducting agent based on the resinous solid content of said inner layer, the outer layer contains 3 to 15% by weight of the same said conducting agent based on the resinous solid content of said outer layer, and the conducting agent content A (wt %) of said inner layer and the conducting agent content B (wt %) of said outer layer satisfies the relationship: $B/A<1.0$.

2. The carrier for an electrophotographic developer according to claim 1, wherein B/A is 0.2 to 0.8.

3. The carrier for an electrophotographic developer according to claim 2, wherein said conducting agent content A of said inner layer is 10 to 15% by weight, and said conducting agent content B of said outer layer is 5 to 10% by weight both based on the resinous solid content of the respective layers.

4. An electrophotographic developer comprising a toner and a carrier according to claim 3.

5. An electrophotographic developer comprising a toner and a carrier according to claim 2.

6. The carrier for an electrophotographic developer according to claim 1, wherein said conducting agent content A of said inner layer is 10 to 15% by weight, and said conducting agent content B of said outer layer is 5 to 10% by weight both based on the resinous solid content of the respective layers.

7. An electrophotographic developer comprising a toner and a carrier according to claim 6.

8. An electrophotographic developer comprising a toner and a carrier according to claim 1.

* * * * *